US010643536B2

(12) United States Patent
Yue et al.

(10) Patent No.: US 10,643,536 B2
(45) Date of Patent: May 5, 2020

(54) PIXEL CIRCUIT AND DRIVING METHOD THEREOF, DISPLAY PANEL

(71) Applicant: BOE TECHNOLOGY GROUP CO., LTD., Beijing (CN)

(72) Inventors: Han Yue, Beijing (CN); Xiaochuan Chen, Beijing (CN); Shengji Yang, Beijing (CN); Dongni Liu, Beijing (CN); Lei Wang, Beijing (CN); Jie Fu, Beijing (CN); Pengcheng Lu, Beijing (CN); Li Xiao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 6 days.

(21) Appl. No.: 15/744,476

(22) PCT Filed: Jun. 14, 2017

(86) PCT No.: PCT/CN2017/088267
§ 371 (c)(1),
(2) Date: Jan. 12, 2018

(87) PCT Pub. No.: WO2018/120667
PCT Pub. Date: Jul. 5, 2018

(65) Prior Publication Data

US 2019/0005881 A1 Jan. 3, 2019

(30) Foreign Application Priority Data

Dec. 29, 2016 (CN) ..... 2016 1 1251335

(51) Int. Cl.
*G09G 3/30* (2006.01)
*G09G 3/3241* (2016.01)
(Continued)

(52) U.S. Cl.
CPC ..... *G09G 3/3241* (2013.01); *G09G 3/3208* (2013.01); *G09G 3/3233* (2013.01);
(Continued)

(58) Field of Classification Search
CPC .... G09G 3/3233; G09G 3/3258; G09G 3/006; G09G 2320/0295; G09G 2310/0291; G09G 2330/04; G09G 2330/10
(Continued)

(56) References Cited

U.S. PATENT DOCUMENTS

2006/0061525 A1 3/2006 Kim et al.
2007/0146254 A1 6/2007 Yanai et al.
(Continued)

FOREIGN PATENT DOCUMENTS

CN 1991949 A 7/2007
CN 101276528 A 10/2008
(Continued)

OTHER PUBLICATIONS

International Search Report of PCT/CN2017/088267 in Chinese, dated Sep. 26, 2017 with English translation.
(Continued)

*Primary Examiner* — Jennifer T Nguyen
(74) *Attorney, Agent, or Firm* — Collard & Roe, P.C.

(57) ABSTRACT

A pixel circuit and a driving method thereof, a display panel. The pixel circuit includes a driving circuit, a light emitting circuit and a short-circuit protection circuit. The short-circuit protection circuit is connected in series between the driving circuit and the light emitting circuit, and the short-circuit protection circuit is configured to obtain an input terminal signal of the light emitting circuit and disconnect or connect an input signal branch of the light emitting circuit according to the obtained input terminal signal of the light emitting circuit.

15 Claims, 3 Drawing Sheets

(51) Int. Cl.
*G09G 3/3208* (2016.01)
*G09G 3/3233* (2016.01)

(52) U.S. Cl.
CPC ..... *G09G 2300/0809* (2013.01); *G09G 2300/0861* (2013.01); *G09G 2330/10* (2013.01); *G09G 2330/12* (2013.01)

(58) Field of Classification Search
USPC ..... 345/76–80, 98–100, 690–691
See application file for complete search history.

(56) References Cited

U.S. PATENT DOCUMENTS

2015/0235595 A1* 8/2015 Sugihara ..... G09G 3/3233 345/691
2015/0339975 A1* 11/2015 Liu ..... G09G 5/10 345/204

FOREIGN PATENT DOCUMENTS

| | | | |
|---|---|---|---|
| CN | 104167181 | A | 11/2014 |
| CN | 106486041 | A | 3/2017 |
| CN | 106531071 | A | 3/2017 |
| CN | 106531080 | A | 3/2017 |
| CN | 206301579 | U | 7/2017 |
| CN | 206301580 | U | 7/2017 |

OTHER PUBLICATIONS

Notice of Transmittal of the International Search Report of PCT/CN2017/088267 in Chinese, dated Sep. 26, 2017.
Written Opinion of the International Searching Authority of PCT/CN2017/088267 in Chinese, dated Sep. 26, 2017 with English translation.
First Chinese Office Action in Chinese Application No. 201611251335.6, dated Sep. 28, 2017 with English translation.
Second Chinese Office Action in Chinese Application No. 201611251335.6, dated Jan. 29, 2018 with English translation.

* cited by examiner

PIXEL CIRCUIT AND DRIVING METHOD THEREOF, DISPLAY PANEL

CROSS REFERENCE TO RELATED APPLICATIONS

This application is the National Stage of PCT/CN2017/088267 filed on Jun. 14, 2017, which claims priority under 35 U.S.C. § 119 of Chinese Application No. 201611251335.6 filed on Dec. 29, 2016, the disclosure of which is incorporated by reference.

TECHNICAL FIELD

Embodiments of the present disclosure relate to a pixel circuit and a driving method thereof, and a display panel.

BACKGROUND

With development of display technology, OLED (organic light emitting diode) displays, as a new type of display devices, have been more and more widely used.

In a micro display structure of an OLED device, a cathode, an anode and functional structure film layers located between the cathode and the anode are included. Due to thinness of each layer of the functional structure film layers, it is easy to produce a short circuit between the cathode and the anode. In a manufacturing process, a manufacturing procedure of the OLED device is complex; in a case that abnormal substances exist on the functional structure film layers, or manufacturing processes such as digging hole, climbing up and other processes are not controlled well, it may cause thinness of the functional structure film layers, leading to a smaller resistance between the cathode and the anode of the OLED device, so that the short circuit occurs between the anode and the cathode. If the short circuit occurs between the anode and the cathode of the OLED device in a pixel circuit, not only the malfunctioned pixel do not emit light, and a black dot appears in the malfunctioned pixel, but also a large current will be generated at the malfunctioned pixel, and the large current also affects a light emitting state of pixels around the malfunctioned pixel. Therefore, the short circuit between the cathode and the anode of the OLED device can seriously affect display quality.

In order to ensure the display quality, it is required to remove the malfunctioned pixel, so as to suppress the large current caused by the short circuit between the cathode and the anode of the OLED device. Currently, in the pixel circuit, a method for handling the short circuit between the cathode and the anode of the OLED device comprises: firstly finding the malfunctioned pixel through a lookup approach, and then destroying the malfunctioned pixel by using laser ablation. This handling method is not only complicated in process, but also difficult to remedy in a case of generating a new malfunctioned pixel.

SUMMARY

At least one embodiment of the present disclosure provides a pixel circuit and a driving method thereof, a display panel, which can at least achieve automatically detecting an input terminal signal of a light emitting device, and can solve a pixel anomaly problem caused by a short circuit between a cathode and an anode of the light emitting device.

At least one embodiment of the present disclosure provides a pixel circuit, comprising: a driving circuit, a light emitting circuit and a short-circuit protection circuit. The short-circuit protection circuit is connected in series between the driving circuit and the light emitting circuit, and is configured to obtain an input terminal signal of the light emitting circuit and disconnect or connect an input signal branch of the light emitting circuit according to the input terminal signal of the light emitting circuit.

For example, in the pixel circuit provided in an embodiment of the disclosure, the short-circuit protection circuit comprises: a short circuit protection transistor and a signal control circuit. The signal control circuit comprises an input terminal being connected to an input terminal of the light emitting circuit and an output terminal being connected to a control electrode of the short circuit protection transistor, and is configured to obtain the input terminal signal of the light emitting circuit and output a short circuit control signal; and the short circuit protection transistor comprises a first electrode being connected to an output terminal of the driving circuit and a second electrode being connected to the input terminal of the light emitting circuit, and is configured to disconnect or connect the input signal branch of the light emitting circuit according to the short circuit control signal output by the signal control circuit.

For example, in the pixel circuit provided in an embodiment of the disclosure, the signal control circuit comprises a judgment control circuit. The judgment control circuit comprises an input terminal being connected to the input terminal of the light emitting circuit and an output terminal being connected to the control electrode of the short circuit protection transistor, and is configured to obtain the input terminal signal of the light emitting circuit and output the short circuit control signal in a case that the light emitting circuit is in an operation stage.

For example, in the pixel circuit provided in an embodiment of the disclosure, the signal control circuit further comprises a pre-charge circuit, the pre-charge circuit is connected in series between the judgment control circuit and the control electrode of the short circuit protection transistor, the pre-charge circuit is configured to control the short circuit protection transistor to be in a turned-on state in a case that the light emitting circuit is in a non-operation stage, and is further configured to transmit the short circuit control signal to the control electrode of the short circuit protection transistor in a case that the light emitting circuit is in the operation stage.

For example, in the pixel circuit provided in an embodiment of the disclosure, the judgment control circuit comprises a first judgment transistor and a second judgment transistor. A control electrode of the first judgment transistor is connected to an input terminal of the light emitting circuit, a first electrode of the first judgment transistor is connected to a first voltage signal, and a second electrode of the first judgment transistor is connected to a second electrode of the second judgment transistor; a control electrode of the second judgment transistor is connected to the input terminal of the light emitting circuit, a first electrode of the second judgment transistor is connected to a second voltage signal, and a second electrode of the second judgment transistor is connected to the control electrode of the short circuit protection transistor; and a type of the first judgment transistor and a type of the second judgment transistor are opposite.

For example, in the pixel circuit provided in an embodiment of the disclosure, the pre-charge circuit comprises a first pre-charge transistor, a second pre-charge transistor, a third pre-charge transistor and a pre-charge capacitor. A control electrode of the first pre-charge transistor is connected to a first control signal terminal, a first electrode of the first pre-charge transistor is connected to a third voltage signal, and a second electrode of the first pre-charge transistor is connected to the control electrode of the short circuit protection transistor; a control electrode of the second pre-charge transistor is connected to a second control signal terminal, a first electrode of the second pre-charge transistor is connected to a fourth voltage signal, and a second electrode of the second pre-charge transistor is connected to a second electrode of the third pre-charge transistor; a control electrode of the third pre-charge transistor is connected to a third control signal terminal, and a first electrode of the third pre-charge transistor is connected to the output terminal of the judgment control circuit; and a first terminal of the pre-charge capacitor is connected to the control electrode of the short circuit protection transistor, and a second terminal of the pre-charge capacitor is connected to the second electrode of the third pre-charge transistor.

For example, the pixel circuit provided in an embodiment of the disclosure further comprises a switch circuit, configured to transmit a data signal to a control terminal of the driving circuit in a case of the switch circuit being turned on.

For example, in the pixel circuit provided in an embodiment of the disclosure, the light emitting circuit is an organic electroluminescent device, an anode of the organic electroluminescent device is connected to an input terminal of the short-circuit protection circuit, and a cathode of the organic electroluminescent device is connected to a ground terminal.

At least an embodiment of the disclosure provides a driving method used for a pixel circuit, comprising: in an operation stage, inputting a data signal to a control terminal of the driving circuit, and outputting a light emitting signal corresponding to the data signal to the light emitting circuit through the driving circuit, the light emitting signal being the input terminal signal of the light emitting circuit. The operation stage comprises a short circuit detection stage; and in the short circuit detection stage, the input terminal signal of the light emitting circuit is obtained through the short-circuit protection circuit, and the input signal branch of the light emitting circuit is disconnected or connected according to the input terminal signal of the light emitting circuit.

For example, in the driving method of the pixel circuit provided in an embodiment of the disclosure, in the short circuit detection stage, a signal control circuit obtains the input terminal signal of the light emitting circuit and outputs a short circuit control signal, and a short circuit protection transistor disconnects or connects the input signal branch of the light emitting circuit according to the short circuit control signal output by the signal control circuit.

For example, the driving method of the pixel circuit further comprises: in a non-operation stage, outputting a signal through a pre-charge circuit to turn on the short circuit protection transistor; and in the short circuit detection stage, obtaining the input terminal signal of the light emitting circuit through a judgment control circuit, outputting the short circuit control signal, and transmitting the short circuit control signal to a control electrode of the short circuit protection transistor through the pre-charge circuit, so as to disconnect or connect the input signal branch of the light emitting circuit.

At least an embodiment of the disclosure further provides a display panel, comprising any pixel circuit described above.

BRIEF DESCRIPTION OF THE DRAWINGS

In order to clearly illustrate the technical solutions of the embodiments of the disclosure, the drawings required for describing the embodiments or related technologies will be briefly described in the following; it is obvious that the described drawings are only related to some embodiments of the present disclosure and thus are not limitative to the present disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the disclosure.

Embodiment 1

An embodiment provides a pixel circuit. The pixel circuit can achieve automatic short circuit protection. Once a short circuit occurs between the cathode and the anode of the light emitting device, a closed loop that controls to drive the light emitting device to emit light is disconnected, so as to achieve the automatic short circuit protection and avoid a pixel anomaly problem caused by the short circuit between the cathode and the anode of the light emitting device. Moreover, a structure of the pixel circuit is simple and stable, and a driving method of the pixel circuit is simple and easy to be implemented.

Figure 1:
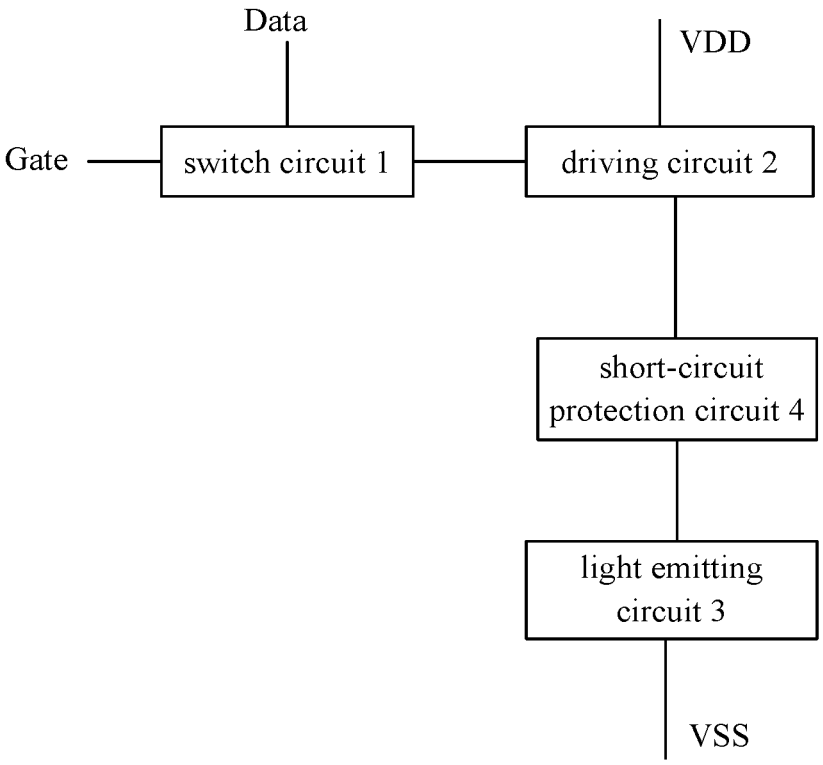
FIG. 1 is a structural schematic diagram of a pixel circuit provided by an embodiment of the present disclosure.

For example, as shown in FIG. 1, the pixel circuit may comprise a driving circuit 2, a light emitting circuit 3 and a short-circuit protection circuit 4. The short-circuit protection circuit 4 is connected in series between the driving circuit 2 and the light emitting circuit 3. The short-circuit protection circuit 4 is configured to obtain an input terminal signal of the light emitting circuit 3 and to turn off or turn on the short-circuit protection circuit 4 itself according to the obtained input terminal signal of the light emitting circuit 3, so that an input signal branch of the light emitting circuit 3 is disconnected or connected so as to prevent a light emitting state of the light emitting circuit 3 from being affected by a short circuit occurring between the cathode and the anode inside the light emitting circuit 3.

For example, the driving circuit 2 is configured to drive the light emitting circuit 3 to emit light. The driving circuit 2 may transmit a light emitting signal corresponding to a data signal to the light emitting circuit 3, so as to drive the light emitting circuit 3 to emit light. For example, the light emitting signal may be a current signal.

For example, as shown in FIG. 1, the pixel circuit further comprises a switch circuit 1, and the switch circuit 1 is configured to transmit the data signal to a control terminal of the driving circuit 2 in a case of the switch circuit 1 being turned on, so as to control magnitude of a current flowing through the driving circuit 2.

Figure 2:
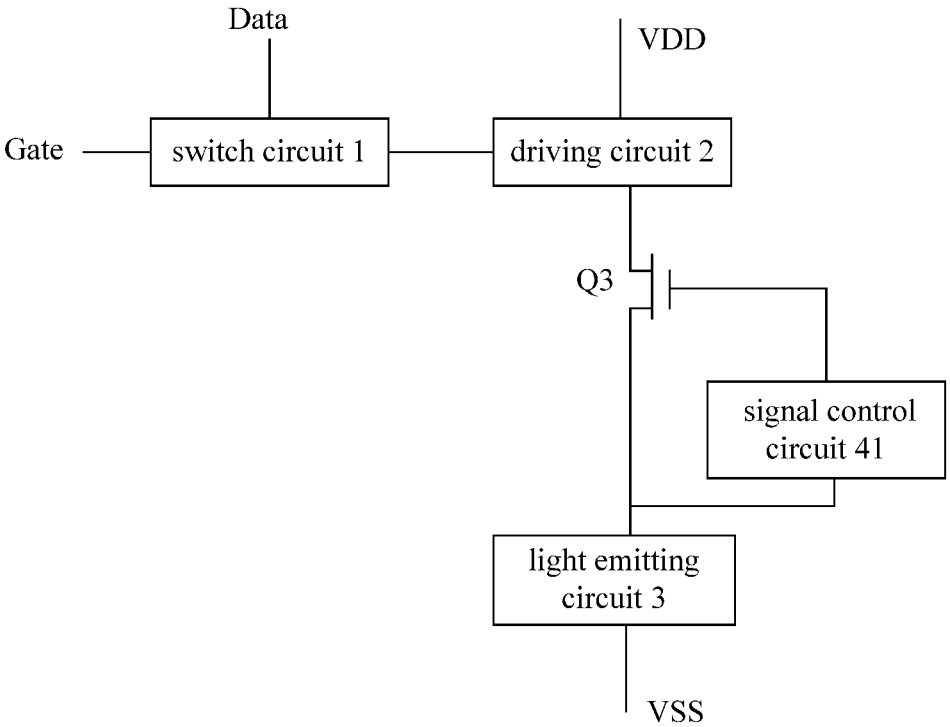
FIG. 2 is a structural schematic diagram of a pixel circuit provided by another embodiment of the present disclosure.

For example, as shown in FIG. 2, in the pixel circuit provided by an embodiment, the short-circuit protection circuit 4 may comprise a short circuit protection transistor Q3 and a signal control circuit 41. An input terminal of the signal control circuit 41 is connected to an input terminal of the light emitting circuit 3 and an output terminal of the signal control circuit 41 is connected to a control electrode of the short circuit protection transistor Q3. And the signal control circuit 41 is configured to obtain the input terminal signal of the light emitting circuit 3 and output a short circuit control signal to the control electrode of the short circuit protection transistor Q3. A first electrode of the short circuit protection transistor Q3 is connected to an output terminal of the driving circuit 2, and a second electrode of the short circuit protection transistor Q3 is connected to the input terminal of the light emitting circuit 3. The short circuit protection transistor Q3 is configured to disconnect or connect the input signal branch of the light emitting circuit 3 according to the short circuit control signal output by the signal control circuit 41, so as to achieve a function of the automatic short circuit protection.

Figure 3:
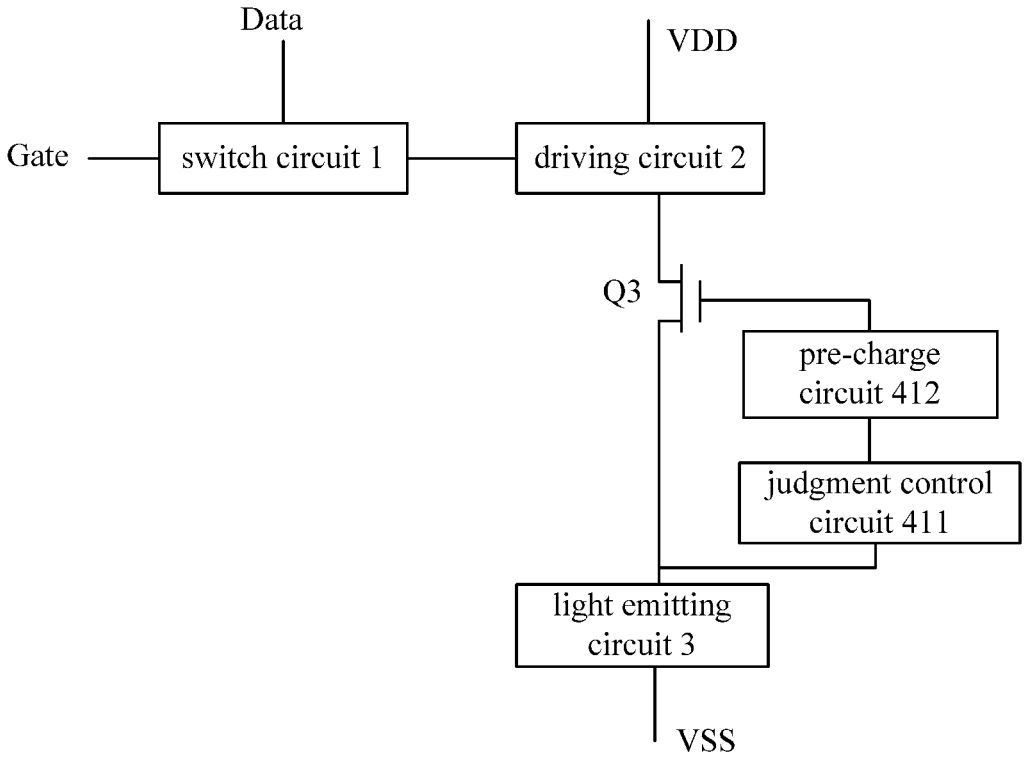
FIG. 3 is a structural schematic diagram of a pixel circuit provided by yet another embodiment of the present disclosure.

Furthermore, as shown in FIG. 3, the signal control circuit 41 comprises a judgment control circuit 411. An input terminal of the judgment control circuit 411 is connected to the input terminal of the light emitting circuit 3, and an output terminal of the judgment control circuit 411 is connected to the control electrode of the short circuit protection transistor Q3. The judgment control circuit 411 is configured to obtain the input terminal signal of the light emitting circuit 3 in a case that the light emitting circuit 3 is in an operation stage. The judgment control circuit 411 is configured to judge whether the short circuit occurs between the anode and the cathode of the light emitting circuit 3 according to the input terminal signal of the light emitting circuit 3 when the light emitting circuit 3 is in the operation stage, and to output different short circuit control signals according to a judgment result. In a case that it is determined that a short circuit phenomenon has occurred in the light emitting circuit 3, a first short circuit control signal is output to control the short circuit protection transistor Q3 to be turned off, so as to disconnect the input signal branch of the light emitting circuit 3; and in a case that it is determined that no short circuit phenomenon occurs in the light emitting circuit 3, a second short circuit control signal is output to control the short circuit protection transistor Q3 to be turned on, so that the input signal branch of the light emitting circuit 3 is kept in a connected state.

For example, as shown in FIG. 3, the signal control circuit 41 further comprises a pre-charge circuit 412. The pre-charge circuit 412 is connected in series between the judgment control circuit 411 and the short circuit protection transistor Q3. The pre-charge circuit 412 is configured to transmit a turn-on signal to the control electrode of the short circuit protection transistor Q3 to turn on the short circuit protection transistor Q3 in a case that the light emitting circuit 3 is in a non-operation stage. The pre-charge circuit 412 is further configured to transmit a short circuit control signal to the control electrode of the short circuit protection transistor Q3 in a case that the light emitting circuit 3 is in a operation stage.

The pre-charge circuit 412 controls the short circuit protection transistor Q3 to be in the turn-on state when the light emitting circuit 3 is in the non-operation stage, so as to ensure that the input signal branch of the light emitting circuit 3 is in a connected state during an initial operation stage. Thus, the light emitting signal can be transmitted to the light emitting circuit 3 to drive the light emitting circuit 3 to emit light and a misjudgment of the judgment control circuit 411 can be prevented.

Figure 4:
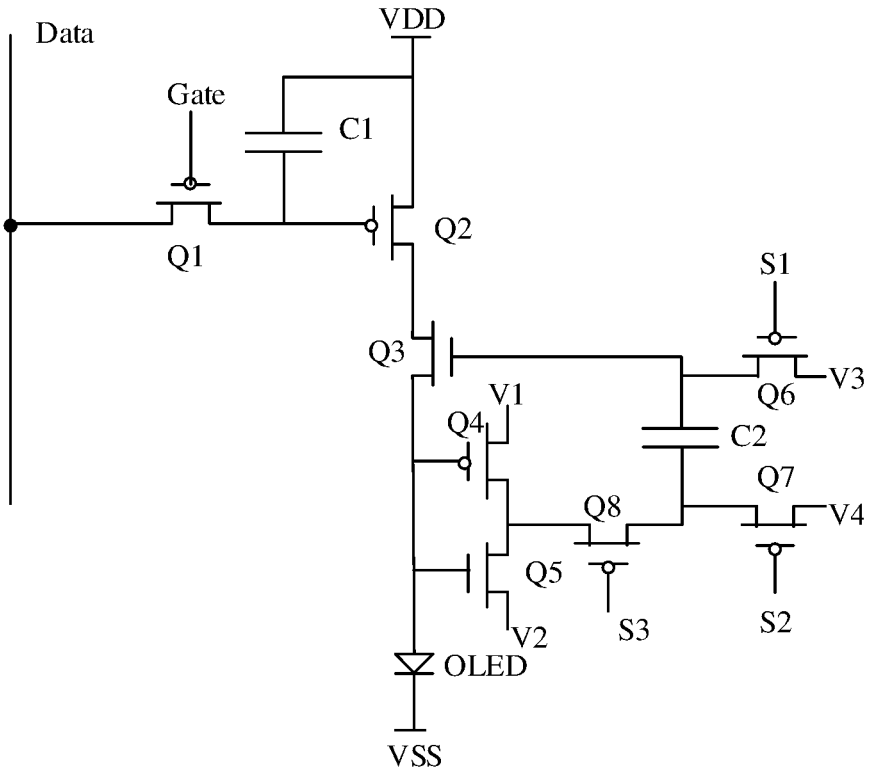
FIG. 4 is a structural schematic diagram of a pixel circuit provided by still yet another embodiment of the present disclosure.

For example, as shown in FIG. 4, the light emitting circuit 3 may comprise an organic electroluminescent device (that is, an OLED device). An anode of the OLED device is connected to the short-circuit protection circuit 4, and a cathode of the OLED device is connected to a ground terminal VSS. The input signal terminal of the light emitting circuit 3 receives the light emitting signal and emits light corresponding to the light emitting signal.

For example, as shown in FIG. 4, the switch circuit 1 comprises a first transistor Q1. For example, the first transistor Q1 is also referred to as a switch transistor Q1. A control electrode of the first transistor Q1 is connected to a switch signal terminal (the switch signal terminal is a scan signal input terminal Gate), a first electrode of the first transistor Q1 is connected to a data signal terminal (the data signal terminal is a data signal input terminal Data), and a second electrode of the first transistor Q1 is connected to an input terminal of the driving circuit 2. In a case that the switch signal terminal applies a scan signal to the control electrode of the first transistor Q1 to turn on the first transistor Q1, the data signal transmitted by the data signal terminal can be written into the control terminal of the driving circuit 2 through the first transistor Q1, so as to control the driving circuit 2 (for example, a second transistor Q2) to be turned on or off.

For example, as shown in FIG. 4, the driving circuit 2 comprises the second transistor Q2 and a storage capacitor C1. For example, the second transistor Q2 may also be referred to as a driving transistor Q2. A first terminal of the storage capacitor C1 is connected to a control electrode of the second transistor Q2, and a second terminal of the storage capacitor C1 is connected to a first electrode of the second transistor Q2. The control electrode of the second transistor Q2 is connected to an output terminal of the switch circuit 1, the first electrode of the second transistor Q2 is connected to an operation voltage VDD, and the second electrode of the second transistor Q2 is connected to the input terminal of the short-circuit protection circuit 4. The control electrode of the second transistor Q2, for example, may be used as the control terminal of the driving circuit 2; that is, the data signal transmitted by the switch circuit 1 may be rewritten into the control electrode of the second transistor Q2, the storage capacitor C1 is configured to store the data signal and keep the data signal in the control electrode of the second transistor Q2, and the data signal may control the turned-on degree of the second transistor Q2, so as to control the magnitude of the current flowing through the second transistor Q2. The current flowing through the second transistor Q2 may be transmitted to the light emitting circuit 3 to drive the light emitting circuit 3 to emit light, and the current flowing through the second transistor Q2 may determine a gray scale of a pixel that emits light.

It is to be noted that, the driving circuit 2 may also includes a transmitting transistor, a detection transistor, a reset transistor and the like as required, and the embodiment of the present disclosure does not limit the driving circuit 2 to a specific structure.

For example, as shown in FIG. 4, the judgment control circuit 411 comprises a first judgment transistor Q4 and a second judgment transistor Q5. A control electrode of the first judgment transistor Q4 is connected to the input terminal of the light emitting circuit 3, a first electrode of the first judgment transistor Q4 is connected to a first voltage signal V1, and a second electrode of the first judgment transistor Q4 is connected to a second electrode of the second judgment transistor Q5. A control electrode of the second judgment transistor Q5 is connected to the input terminal of the light emitting circuit 3, a first electrode of the second judgment transistor Q5 is connected to a second voltage signal V2, and a second electrode of the second judgment transistor Q5 is connected to the control electrode of the short circuit protection transistor Q3.

For example, a type of the first judgment transistor Q4 and a type of the second judgment transistor Q5 are opposite. That is, if the first judgment transistor Q4 is an N-type transistor, the second judgment transistor Q5 is a P-type transistor; alternatively, if the first judgment transistor Q4 is the P-type transistor, the second judgment transistor Q5 is the N-type transistor.

For example, as shown in FIG. 4, the pre-charge circuit 412 comprises a first pre-charge transistor Q6, a second pre-charge transistor Q7, a third pre-charge transistor Q8 and a pre-charge capacitor C2. A control electrode of the first pre-charge transistor Q6 is connected to a first control signal terminal S1, a first electrode of the first pre-charge transistor Q6 is connected to a third voltage signal V3, and a second electrode of the first pre-charge transistor Q6 is connected to the control electrode of the short circuit protection transistor Q3. A control electrode of the second pre-charge transistor Q7 is connected to a second control signal terminal S2, a first electrode of the second pre-charge transistor Q7 is connected to a fourth voltage signal V4, and a second electrode of the second pre-charge transistor Q7 is connected to a second electrode of the third pre-charge transistor Q8. A control electrode of the third pre-charge transistor Q8 is connected to a third control signal terminal S3, and a first electrode of the third pre-charge transistor Q8 is connected to the output terminal of the judgment control circuit 411. A first terminal of the pre-charge capacitor C2 is connected to the control electrode of the short circuit protection transistor Q3, and a second terminal of the pre-charge capacitor C2 is connected to the second electrode of the third pre-charge transistor Q8.

It should be understood herein that, in a case that a transistor is a thin film transistor (TFT for short), a control electrode of the transistor corresponds to a gate electrode of the thin film transistor, and a first electrode and a second electrode of the transistor are respectively a source electrode and a drain electrode (or respectively the drain electrode and the source electrode) of the thin film transistor. The first electrode and the second electrode are interchangeable as needed. That is, the first electrode may be the source electrode or the drain electrode, and correspondingly, the second electrode may be the drain electrode or the source electrode.

In the pixel circuit of the embodiment, the first transistor Q1, the second transistor Q2, the first judgment transistor Q4, the first pre-charge transistor Q6, the second pre-charge transistor Q7 and the third pre-charge transistor Q8 are P-type thin film transistors, the second judgment transistor Q5 and the short circuit protection transistor Q3 are N-type thin film transistors. Similarly, it should be understood that, in a specific application, N-type thin film transistors and P-type thin film transistors may be selected for the thin film transistors Q1-Q8 in the pixel circuit, provided that a control voltage level of the control electrode of each selected type of the thin film transistors Q1-Q8 may be adjusted accordingly. For example, for the N-type thin film transistor, in a case that the control voltage of the control electrode is at a high voltage level, the N-type thin film transistor is turned on; for the P-type thin film transistor, in a case that the control voltage of the control electrode is at a low voltage level, the P-type thin film transistor is turned on. Meanwhile, it should be understood that, the types of the transistors Q1-Q8 in the pixel circuit of the present embodiment are not limited to the thin film transistors, and any pixel circuit, which uses the transistors with a voltage control capability and having the same process as the pixel circuit so that the present disclosure operates according to the above working mode, should be included in the protection scope of the present disclosure. For example, the transistors Q1-Q8 may be field effect transistors (FET for short), more specifically, metal oxide semiconductor field effect transistors (MOSFETs for short). Those skilled in the art can make change(s) according to actual needs, and the details are not described with accompanying drawings here again.

In the pixel circuit of the present embodiment, the transistors Q1, Q3, Q4, Q5, Q6, Q7, Q8 are all switch transistors and the transistor Q2 is a driving transistor.

It is to be noted that, the pixel circuit in the present embodiment adopts a 2T1C (two transistors and one capacitor) circuit to achieve the basic function of driving the light emitting circuit 3 (such as, an OLED device) to emit light. According to actual application needs, the pixel circuit may also have an electrical compensation function, so as to improve the display uniformity of the display panel including the pixel circuit. For example, a compensation function can be implemented by a voltage compensation, current compensation or mixed compensation of voltage and current. The pixel circuit having the compensation function can be implemented as, for example, 4T1C, 4T2C, 6T1C, and other circuits with the electrical compensation function.

Figure 5:
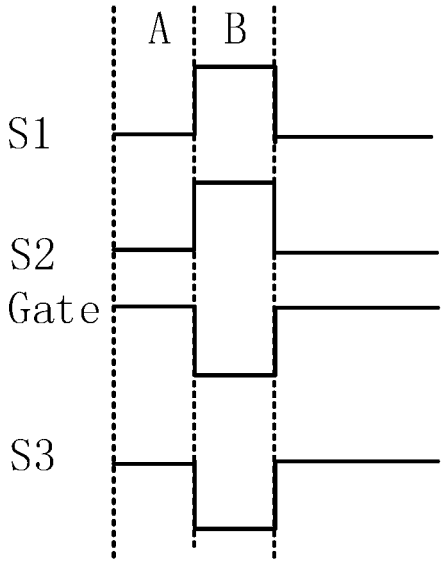
FIG. 5 is a time sequence diagram of a pixel circuit shown in FIG. 4 of the present disclosure.

FIG. 5 is a time sequence diagram of a pixel circuit shown in FIG. 4.

For example, one frame may be divided into an A stage and a B stage, the A stage is the non-operation stage of the light emitting circuit 3 and the B stage is the operation stage of the light emitting circuit 3.

In a case that the light emitting circuit 3 is in the non-operation stage A, the first control signal terminal S1 and the second control signal terminal S2 output active voltage signals before an active signal of the switch signal terminal Gate arrives, so that the first pre-charge transistor Q6 and the second pre-charge transistor Q7 are turned on. The third control signal terminal S3 outputs a non-active voltage signal, so as to turn off the third pre-charge transistor Q8. The third voltage signal V3 and the fourth voltage signal V4 are respectively transmitted to two terminals of the pre-charge capacitor C2. A voltage value of the third voltage signal V3 may turn on the short circuit protection transistor Q3, and a voltage difference between the two terminals of the pre-charge capacitor is V3−V4.

In a case that the light emitting circuit 3 is in the operation stage B, the active signal of the switch signal terminal Gate arrives, the light emitting signal is transmitted to the light emitting circuit 3 through the short circuit protection transistor Q3, and the light emitting circuit 3 operates in normal. At the same time, the first control signal terminal S1 and the second control signal terminal S2 output non-active voltage signals, so that the first pre-charge transistor Q6 and the second pre-charge transistor Q7 are turned off. The third control signal terminal S3 outputs an active voltage signal, so as to turn on the third pre-charge transistor Q8.

For example, in a case that the OLED device of the light emitting circuit 3 is in a normal operation state, an anode signal of the OLED device is a high voltage signal, the first judgment transistor Q4 is turned off, the second judgment transistor Q5 is turned on, and the second voltage signal V2 is transmitted to the second terminal of the pre-charge capacitor C2. Through a bootstrap function of the capacitor, a value of the voltage signal at the first terminal of the pre-charge capacitor C2 becomes V3−V4+V2. This voltage signal serves as a control signal of the control electrode of the short circuit protection transistor Q3, which can ensure that the short circuit protection transistor Q3 is turned on. Thus, in the case that the light emitting circuit 3 is in the normal operation state, the short circuit protection transistor Q3 is turned on, so that the input signal branch of the light emitting circuit 3 is connected.

For example, in a case that the OLED device of the light emitting circuit 3 is in a short circuit state, the anode signal of the OLED device is a low voltage signal, the first judgment transistor Q4 is turned on, the second judgment transistor Q5 is turned off, and the first voltage signal V1 is transmitted to the second terminal of the pre-charge capacitor C2. Through the bootstrap function of the capacitor, the value of the voltage signal of the first terminal of the pre-charge capacitor C2 becomes V3−V4+V1. This voltage signal serves as the control signal of the control electrode of the short circuit protection transistor Q3, which can ensure that the short circuit protection transistor Q3 is turned off. Thus, in the case that the light emitting circuit 3 is in the short circuit state, the input signal branch of the light emitting circuit 3 is disconnected.

In the present embodiment, in order to ensure that the short circuit protection transistor Q3 can be turned on and off according to a preset condition, the values of the first voltage signal V1, the second voltage signal V2, the third voltage signal V3 and the fourth voltage signal V4 satisfy the following relations:

$$V3-\text{Vanode1}>Vth3;$$

$$V3-V4+V2-\text{Vanode2}>Vth3;$$

$$V3-V4+V1-\text{Vanode3}<Vth3;$$

where Vth3 is a threshold voltage of the short circuit protection transistor Q3, and Vanode1 is the input terminal signal of the light emitting circuit 3 in the non-operation stage, that is, the anode signal. The anode signal is approximately close to the voltage value of VSS. Vanode2 is the input terminal signal of the light emitting circuit 3 that is in the normal operation state during the operation stage, that is, in this case, the anode signal is the high voltage signal. The Vanode3 is the input terminal signal of the light emitting circuit 3 that is in the short circuit state during the operation stage, that is, in this case, the anode signal is the VSS.

The active voltage signal output by the first control signal terminal S1 satisfies a condition of turning on the first pre-charge transistor Q6. The active voltage signal output by the second control signal terminal S2 satisfies a condition of turning on the second pre-charge transistor Q7. The active voltage signal output by the third control signal terminal S3 satisfies a condition of turning on the third pre-charge transistor Q8.

It can be seen that, in the pixel circuit, the short-circuit protection circuit 4 is added to achieve automatic short circuit protection of the OLED device. In the normal operation, the anode voltage of the OLED device is the high voltage level; if the short circuit occurs between the cathode and the anode of the OLED device, the anode voltage of the OLED device becomes the low level. In the pixel circuit, the OLED device, as an electronic component with a mega-ohm resistance, is connected in series to a light emitting branch (a VDD-VSS branch); if the short circuit occurs between the cathode and the anode, the resistance of the OLED device is reduced and even reduced to 0 ohm, and so, compared with the OLED device in which no short circuit occurs, the anode voltage of the OLED device in which the short circuit occurs will be greatly reduced. The anode voltage of the OLED device is detected by the switch transistor in the short-circuit protection circuit 4 to obtain the anode voltage of the OLED device in real time, and once the anode voltage is reduced to a low voltage level, the closed loop that controls to drive the OLED device to emit light is disconnected (for example, the short circuit protection transistor Q3 is controlled to be turned off), so as to play the role of the automatic short circuit protection.

The pixel circuit controls the closed loop, which drives the light emitting device to emit light, to be disconnected through the short-circuit protection circuit, so as to avoid the pixel anomaly problem caused by the short circuit between the cathode and the anode of the light emitting device. Moreover, the structure for preventing the short circuit in the pixel circuit is more reliable and stable, the method is simple and easy to implement, and it is not needed to add a laser ablation equipment.

For example, an embodiment further provides a driving method of the pixel circuit.

For example, the driving method comprises: obtaining the input terminal signal of the light emitting circuit 3 through the short-circuit protection circuit 4, and turning off or on the short-circuit protection circuit 4 according to the obtained input signal terminal of the light emitting circuit 3, so that the input signal branch of the light emitting circuit 3 is disconnected or connected, so as to prevent the light emitting state of the light emitting circuit 3 from being affected by the short circuit occurring between the cathode and the anode inside the light emitting circuit 3. The driving method automatically controls the closed loop, which drives the light emitting device to emit light, to be disconnected through the short-circuit protection circuit 4, so as to play the role of the automatic short circuit protection.

For example, the driving method of the pixel circuit comprises the following steps:

In an operation stage, inputting a data signal to a control terminal of a driving circuit, and outputting a light emitting signal corresponding to the data signal to a light emitting circuit through the driving circuit, the light emitting signal being an input terminal signal of the light emitting circuit. The operation stage comprises a short circuit detection stage; in the short circuit detection stage, the input terminal signal of the light emitting circuit is obtained through a short-circuit protection circuit, and an input signal branch of the light emitting circuit is disconnected or connected according to the input terminal signal of the light emitting circuit.

In a case that the short circuit occurs between the cathode and anode of the OLED device in the light emitting circuit 3, in the short circuit detection stage, if the voltage input to the anode of the light emitting circuit 3 is at a high voltage level, then in a case that the short circuit occurs between the cathode and the anode, the voltage of the anode of the light emitting circuit 3 drops to a low voltage level, the short-circuit protection circuit 4 can disconnect the driving circuit 2 from the light emitting circuit 3, so as to prevent the light emitting state of the light emitting circuit 3 from being affected by the short circuit occurring between the cathode and the anode inside the light emitting circuit 3.

For example, the short-circuit protection circuit of the pixel circuit comprises a signal control circuit and a short circuit protection transistor. The driving method further comprises: in the short circuit detecting stage, the signal control circuit obtaining the input terminal signal of the light emitting circuit and outputting a short circuit control signal, and the short circuit protection transistor disconnecting or connecting the input signal branch of the light emitting circuit according to the short circuit control signal output by the signal control circuit.

For example, the signal control circuit of the pixel circuit comprises a judgment control circuit and a pre-charge circuit. The driving method further comprises: in a non-operation stage, outputting a signal through the pre-charge circuit to turn on the short circuit protection transistor; in the short circuit detection stage, obtaining the input terminal signal of the light emitting circuit through the judgment control circuit and outputting the short circuit control signal, and transmitting the short circuit control signal to a control electrode of the short circuit protection transistor through the pre-charge circuit, so as to disconnect or connect the input signal branch of the light emitting circuit.

It can be seen from the above that, based on the pixel circuit provided by the embodiment, the driving method corresponding to the pixel circuit controls the closed loop, which drives the light emitting device to emit light, to be disconnected through the short-circuit protection circuit, so as to play the role of the automatic short circuit protection.

Embodiment 2

An embodiment provides a display panel. The display panel has better display performance and display quality.

For example, the display panel comprises a plurality of pixel circuits arranged in an array, at least one of the plurality of pixel circuits is the pixel circuit according to any one of the first embodiment. The display panel can be an electronic paper, an OLED panel, a mobile phone, a tablet, a television, a monitor, a notebook computer, a digital photo frame, a navigator, or any products or components having a display function.

The pixel circuit in the display panel can achieve automatic short circuit protection, so as to avoid a pixel anomaly problem caused by the short circuit occurring between the cathode and the anode of the light emitting device. Therefore, the display panel has better display quality.

It can be understood that, the above embodiments are merely exemplary embodiments used for illustrating the principle of the present disclosure, but the present disclosure is not limited thereto. For the person skilled in the art, various modifications and improvements can be made to the present disclosure without departing from the spirit and essence of the present disclosure, and the modifications and improvements are also considered to be within the scope of the present disclosure.

The application claims priority to the Chinese patent application No. 201611251335.6, filed Dec. 29, 2016, the entire disclosure of which is incorporated herein by reference as part of the present application.

What is claimed is:

1. A pixel circuit, comprising:

a driving circuit, a light emitting circuit having an input terminal and a short-circuit protection circuit, wherein the short-circuit protection circuit is connected in series between the driving circuit and the light emitting circuit, and is configured to obtain an input terminal signal of the light emitting circuit and disconnect or connect an input signal branch of the light emitting circuit according to the input terminal signal of the light emitting circuit;

wherein the short-circuit protection circuit comprises: a short circuit protection transistor and a signal control circuit, the signal control circuit comprises an input terminal being connected to an input terminal of the light emitting circuit and an output terminal being directly connected to a control electrode of the short circuit protection transistor, and is configured to obtain the input terminal signal of the light emitting circuit and output a short circuit control signal; and the short circuit protection transistor comprises a first electrode being connected to an output terminal of the driving circuit and a second electrode being connected to the input terminal of the light emitting circuit, and is configured to disconnect or connect the input signal branch of the light emitting circuit according to the short circuit control signal output by the signal control circuit;

a judgment control circuit comprising:

an input terminal being connected to the input terminal of the light emitting circuit and an output terminal being connected to the control electrode of the short circuit protection transistor, and is configured to obtain the input terminal signal of the light emitting circuit and output the short circuit control signal in a case that the light emitting circuit is in an operation stage;

wherein the judgment control circuit comprises a first judgment transistor having a control electrode, a first electrode and a second electrode and a second judgment transistor having a control electrode, a first electrode and a second electrode, wherein the control electrode of the first judgment transistor is connected to an input terminal of the light emitting circuit, the first electrode of the first judgment transistor is connected to a first voltage signal, and the second electrode of the first judgment transistor is connected to a second electrode of the second judgment transistor;

wherein the control electrode of the second judgment transistor is connected to the input terminal of the light emitting circuit, the first electrode of the second judgment transistor is connected to a second voltage signal, and the second electrode of the second judgment transistor is connected to the control electrode of the short circuit protection transistor; and wherein a type of the first judgment transistor and a type of the second judgment transistor are opposite.

2. The pixel circuit according to claim 1, wherein the signal control circuit further comprises a pre-charge circuit, the pre-charge circuit is connected in series between the judgment control circuit and the control electrode of the short circuit protection transistor, the pre-charge circuit is configured to control the short circuit protection transistor to be in a turned-on state in a case that the light emitting circuit is in a non-operation stage, and is further configured to transmit the short circuit control signal to the control electrode of the short circuit protection transistor in a case that the light emitting circuit is in the operation stage.

3. The pixel circuit according to claim 2, wherein the pre-charge circuit comprises a first pre-charge transistor, a second pre-charge transistor, a third pre-charge transistor and a pre-charge capacitor, a control electrode of the first pre-charge transistor is connected to a first control signal terminal, a first electrode of the first pre-charge transistor is connected to a third voltage signal, and a second electrode of the first pre-charge transistor is connected to the control electrode of the short circuit protection transistor;

a control electrode of the second pre-charge transistor is connected to a second control signal terminal, a first electrode of the second pre-charge transistor is connected to a fourth voltage signal, and a second electrode of the second pre-charge transistor is connected to a second electrode of the third pre-charge transistor;

a control electrode of the third pre-charge transistor is connected to a third control signal terminal, and a first electrode of the third pre-charge transistor is connected to the output terminal of the judgment control circuit; and a first terminal of the pre-charge capacitor is connected to the control electrode of the short circuit protection transistor, and a second terminal of the pre-charge capacitor is connected to the second electrode of the third pre-charge transistor.

4. The pixel circuit according to claim 2, further comprising a switch circuit, configured to transmit a data signal to a control terminal of the driving circuit in a case of the switch circuit being turned on.

5. The pixel circuit according to claim 2, wherein the light emitting circuit is an organic electroluminescent device, an anode of the organic electroluminescent device is connected to an input terminal of the short-circuit protection circuit, and a cathode of the organic electroluminescent device is connected to a ground terminal.

6. The pixel circuit according to claim 1, further comprising a switch circuit, configured to transmit a data signal to a control terminal of the driving circuit in a case of the switch circuit being turned on.

7. The pixel circuit according to claim 1, wherein the light emitting circuit is an organic electroluminescent device, an anode of the organic electroluminescent device is connected to an input terminal of the short-circuit protection circuit, and a cathode of the organic electroluminescent device is connected to a ground terminal.

8. A driving method used for a pixel circuit according to claim 1, comprising:

in an operation stage, inputting a data signal to a control terminal of the driving circuit, and outputting a light emitting signal corresponding to the data signal to the light emitting circuit through the driving circuit, the light emitting signal being the input terminal signal of the light emitting circuit;

wherein the operation stage comprises a short circuit detection stage; and in the short circuit detection stage, the input terminal signal of the light emitting circuit is obtained through the short-circuit protection circuit, and the input signal branch of the light emitting circuit is disconnected or connected according to the input terminal signal of the light emitting circuit.

9. The driving method of the pixel circuit according to claim 8, wherein:

in the short circuit detection stage, a signal control circuit obtains the input terminal signal of the light emitting circuit and outputs a short circuit control signal, and a short circuit protection transistor disconnects or connects the input signal branch of the light emitting circuit according to the short circuit control signal output by the signal control circuit.

10. The driving method of the pixel circuit according to claim 9, further comprising:

in a non-operation stage, outputting a signal through a pre-charge circuit to turn on the short circuit protection transistor; and in the short circuit detection stage, obtaining the input terminal signal of the light emitting circuit through a judgment control circuit, outputting the short circuit control signal, and transmitting the short circuit control signal to a control electrode of the short circuit protection transistor through the pre-charge circuit, so as to disconnect or connect the input signal branch of the light emitting circuit.

11. A display panel, comprising a pixel circuit according to claim 1.

12. The pixel circuit according to claim 1, further comprising a switch circuit, configured to transmit a data signal to a control terminal of the driving circuit in a case of the switch circuit being turned on.

13. The pixel circuit according to claim 1, wherein the light emitting circuit is an organic electroluminescent device, an anode of the organic electroluminescent device is connected to an input terminal of the short-circuit protection circuit, and a cathode of the organic electroluminescent device is connected to a ground terminal.

14. The pixel circuit according to claim 1, wherein the first judgment transistor is an N-type transistor, the second judgment transistor is a P-type transistor.

15. The pixel circuit according to claim 1, wherein the first judgment transistor is a P-type transistor, the second judgment transistor is an N-type transistor.

* * * * *